US006551168B1

(12) United States Patent
Hou

(10) Patent No.: US 6,551,168 B1
(45) Date of Patent: Apr. 22, 2003

(54) WALL SUSPENSION TYPE TOY STRUCTURE

(76) Inventor: Chin-Jung Hou, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/087,166

(22) Filed: Feb. 27, 2002

(65) Prior Publication Data

(65)

(51) Int. Cl.[7] ..... A63H 3/28; A63H 11/00; G09F 19/08

(52) U.S. Cl. ..... 446/301; 446/320; 446/330; 40/411; 40/414

(58) Field of Search ..... 446/268, 320, 446/300, 330, 301, 331, 353, 354, 337, 352; 40/411, 414, 415, 416, 421, 423

(56) References Cited

U.S. PATENT DOCUMENTS 5,222,738 A * 6/1993 Muller ..... 273/142 H
6,322,421 B1 * 11/2001 Hou ..... 446/485
6,343,971 B1 * 2/2002 Hou ..... 446/358
6,450,855 B1 * 9/2002 Tang ..... 446/330
6,491,567 B2 * 12/2002 Chan ..... 446/478

* cited by examiner

*Primary Examiner*—Jacob K. Ackun
*Assistant Examiner*—Faye Francis

(57) ABSTRACT

A wall suspension type toy structure includes a base, a telescopic unit, a base plate, an open/close unit, a first drive unit, an upper seat, a second drive unit, and an ornament. In such a manner, the flower loop decoration may be expanded or contracted reciprocally, and the mouth of the outer shade of the head may be opened and closed continuously, thereby providing a lively amusement effect.

5 Claims, 12 Drawing Sheets

WALL SUSPENSION TYPE TOY STRUCTURE

BACKGROUND OF THE INVENTION

1. Field of the Invention

The present invention relates to a wall suspension type toy structure, and more particularly to a wall suspension type toy structure, wherein the flower loop decoration may be expanded or contracted reciprocally, and the mouth of the outer shade of the head may be opened and closed continuously, thereby providing a lively amusement effect.

2. Description of the Related Art A conventional toy in accordance with the prior art cannot actually simulate the real action of the human body according to the pattern of the toy structure itself. Most of the toy structure can only provide a single playing effect, and the manufacturer does not pay attention to the quality of the toy structure so that it is difficult to enhance the value and the amusement effect of the toy structure. In addition, the conventional toy cannot enhance the true activity and mobility of its head, hands, and the like, thereby greatly limiting the versatility of the conventional toy.

SUMMARY OF THE INVENTION

The present invention has arisen to mitigate and/or obviate the disadvantage of the conventional toy.

The primary objective of the present invention is to provide a wall suspension type toy structure that may simulate the actions of the human body, wherein the flower loop decoration may be expanded or contracted reciprocally, and the mouth of the outer shade of the head may be opened and closed continuously, thereby providing a lively amusement effect.

Another objective of the present invention is to provide a wall suspension type toy structure that may simulate the expansion and contraction actions of the flowers.

In accordance with the present invention, there is provided a wall suspension type toy structure, comprising a base, a telescopic unit, a base plate, an open/close unit, a first drive unit, and an upper seat, wherein:

the base is a rectangular hollow box, and has an inside provided with a battery compartment and a switch located beside the battery compartment, the base has four sides each formed with multiple cavities, two protruding ears are mounted on two opposite sides of the base;

the telescopic unit includes multiple substantially Z-shaped rack slide bars arranged in a radiating manner, and multiple short slide bars each mounted between any two adjacent rack slide bars, each of the rack slide bars is matingly received in one of the multiple cavities of the base, each of the rack slide bars has a first end formed with multiple engaging teeth and a second end formed with a flat mounting section which has a distal end formed with two screw bores for screwing of screw members, each of the multiple short slide bars is an elongate rectangular bar that is received in one of the multiple cavities 13 of the base, each of the multiple short slide bars has a distal end formed with two screw bores for screwing of screw members;

the base plate is a circular plate that is mounted above the base and the telescopic unit, the base plate has a center formed with a circular hole for passage of a drive gear which meshes with each of the rack slide bars that are mounted on a bottom of the base plate, the base plate has a top provided with multiple threaded rods, the base plate has a periphery formed with multiple elongated cutouts aligning with the rack slide bars, and multiple short cutouts each located between any two adjacent elongated cutouts, each of the multiple elongated cutouts has a bottom provided with two substantially L-shaped holding plates, so that each of the rack slide bars is slidably mounted between the two substantially L-shaped holding plates, each of the multiple short cutouts has a bottom provided with a substantially U-shaped plate, so that each of the multiple short slide bars is slidably mounted in the substantially U-shaped plates;

the open/close unit is mounted above the base plate, and includes multiple larger sector plates and multiple smaller sector plates arranged in a staggered manner, each of the multiple larger sector plates is rested on the top of the base plate, and has a surface formed with two arcuate slots, each of the multiple larger sector plates has a bottom having a mediate portion provided with a mounting block which is secured on the distal end of a respective one of the multiple short slide bars by screw members, and is slidably mounted in a respective one of the multiple short cutouts of the base plate, each of the multiple smaller sector plates is mounted between any two adjacent larger sector plates in a staggered manner, and has a surface provided with multiple intersecting ribs, each of the multiple smaller sector plates has a bottom having two sides each provided with a threaded post which is received in an arcuate slot of an adjacent larger sector plate, and is secured by a screw member, so that the multiple larger sector plates may be combined with the multiple smaller sector plates, the bottom of each of the multiple smaller sector plates has a mediate portion provided with a plate block which is secured on the distal end of a respective one of the multiple rack slide bars by screw members, and is slidably mounted in a respective one of the multiple elongated cutouts of the base plate;

the first drive unit includes a hollow gearbox cover, and a first motor secured on a top of the hollow gearbox cover, the first motor has a shaft that may drive a belt wheel set which is mounted on a bottom of the hollow gearbox cover, the belt wheel set may in turn drive and rotate multiple reduction gears which are mounted in the hollow gearbox cover, one of the reduction gears is co-axially connected with the drive gear; and the upper seat is a hollow seat that is secured on the base plate for receiving the first drive unit and a horn, the upper seat has a top formed with a motor chamber for receiving the first motor of the first drive unit, the top of the upper seat is provided with two opposite U-shaped enclosures, and two opposite support racks each secured in one of the two opposite U-shaped enclosures, each of the two opposite U-shaped enclosures is formed with two screw bores, each of the two opposite support racks has a bottom plate formed with two slots aligning with the two screw bores of one of the two opposite U-shaped enclosures, for passage of screw members, so that the bottom plate of each of the two opposite support racks may be secured in each of the two opposite U-shaped enclosures, each of the two opposite support racks is formed with two post holes.

The wall suspension type toy structure further comprises a second drive unit secured on the two opposite support racks, and including a main body, a side cover combined with the main body, a second motor, two links, a lower lip plate, and an upper lip plate, wherein:

the main body has an outer side provided with two threaded posts aligning with the two post holes of one of the two opposite support racks, for passage of screw members, so that the main body may be secured on the two opposite support racks;

the side cover has an outer side provided with two threaded posts aligning with the two post holes of the other support rack, for passage of screw members, so that the side cover may be secured on the other support rack;

the second motor is mounted in the main body, and has a shaft that may in turn drive and rotate multiple reduction gears which are mounted in the main body, and one of the reduction gears has a shaft which has two ends protruded outward from the main body and the side cover respectively;

each of the two links has a first end secured on one of the two ends of the shaft of the one reduction gear, and a second end secured with a lower portion of the lower lip plate, a torsion spring is mounted between the lower portion of the lower lip plate and the main body; and the upper lip plate is secured on the main body, and is located above the lower lip plate, the upper lip plate has a lower portion provided with an inverted U-shaped connecting plate secured on the main body and the side cover.

Further benefits and advantages of the present invention will become apparent after a careful reading of the detailed description with appropriate reference to the accompanying drawings.

DETAILED DESCRIPTION OF THE INVENTION

Figure 1:
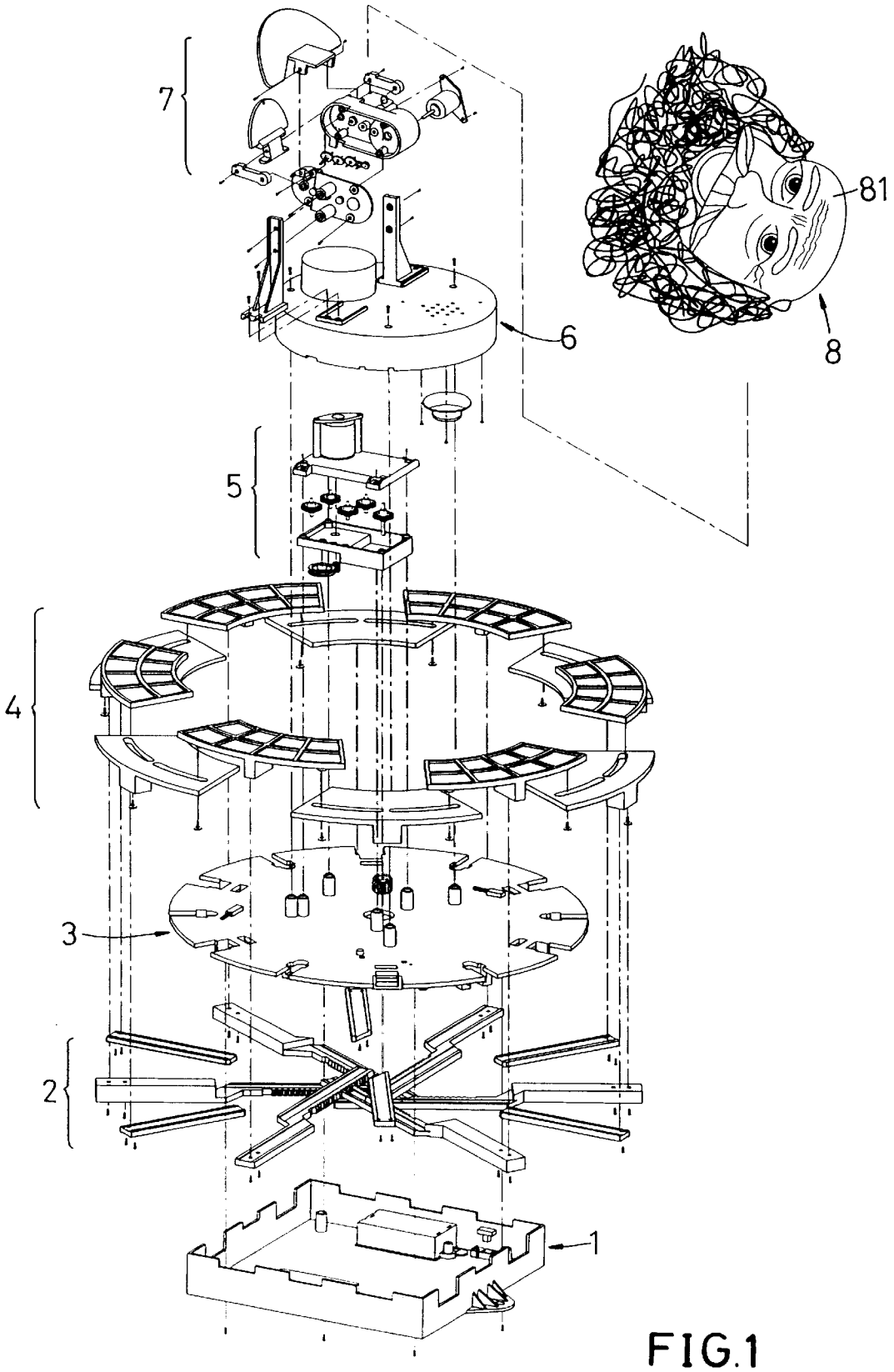
FIG. 1 is an exploded perspective view of a wall suspension type toy structure in accordance with a preferred embodiment of the present invention.

Referring to the drawings and initially to FIGS. 1–10, a wall suspension type toy structure in accordance with a preferred embodiment of the present invention comprises a base 1, a telescopic unit 2, a base plate 3, an open/close unit 4, a first drive unit 5, an upper seat 6, a second drive unit 7, and an ornament 8.

Figure 2:
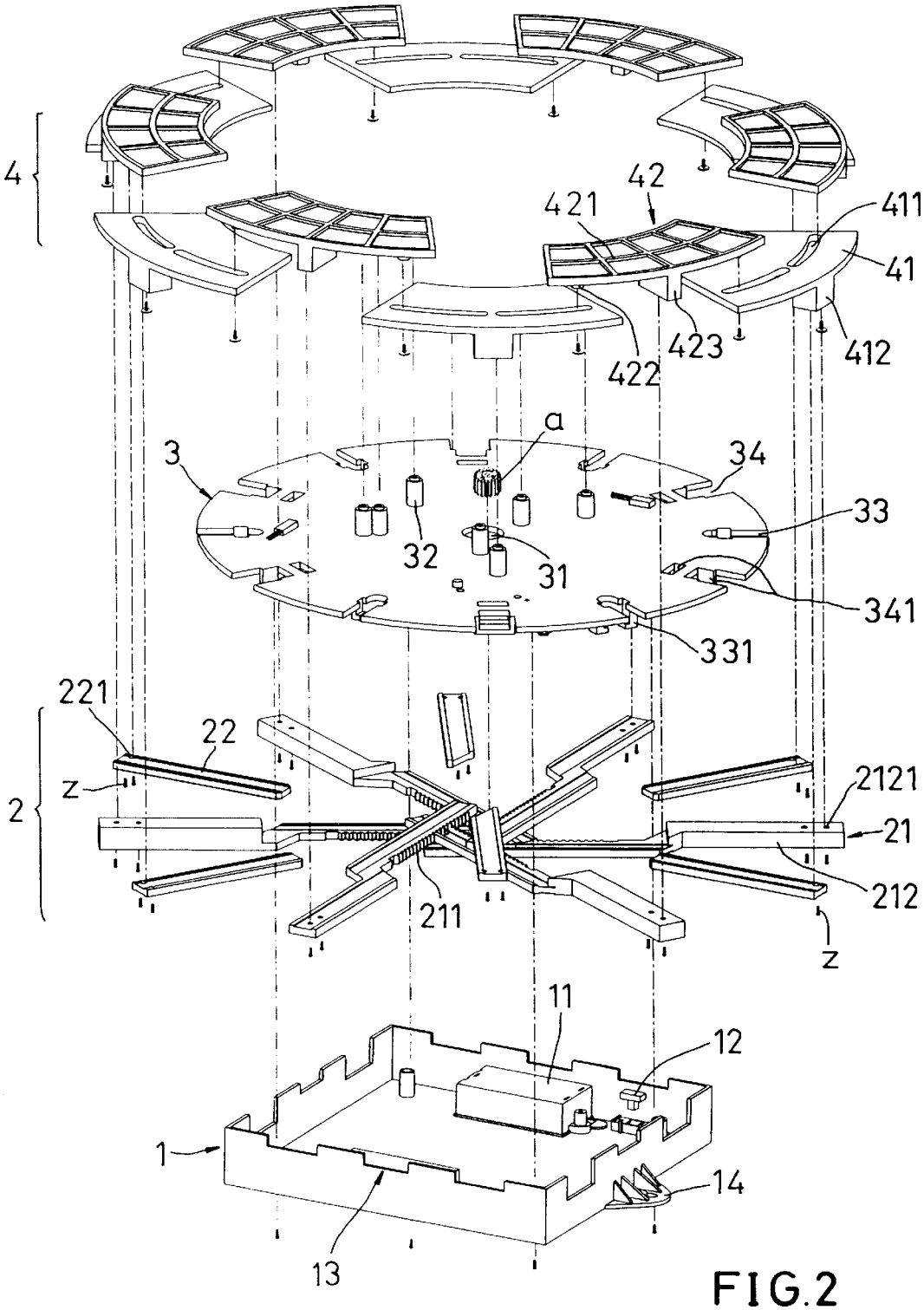
FIG. 2 is an exploded perspective view of a lower body of the wall suspension type toy structure in accordance with a preferred embodiment of the present invention.

As shown in FIGS. 1 and 2, the base 1 is a rectangular hollow box, and has an inside provided with a battery compartment 11 and a switch 12 located beside the battery compartment 11. The base 1 has four sides each formed with multiple cavities 13. Two protruding ears 14 are mounted on two opposite sides of the base 1.

The telescopic unit 2 includes multiple substantially Z-shaped rack slide bars 21 arranged in a radiating manner, and multiple short slide bars 22 each mounted between any two adjacent rack slide bars 21. Each of the rack slide bars 21 is matingly received in one of the multiple cavities 13 of the base 1. Each of the rack slide bars 21 has a first end formed with multiple engaging teeth 211 and a second end formed with a flat mounting section 212 which has a distal end formed with two screw bores 2121 for screwing of screw members "Z". Each of the multiple short slide bars 22 is an elongate rectangular bar that is received in one of the multiple cavities 13 of the base 1. Each of the multiple short slide bars 22 has a distal end formed with two screw bores 221 for screwing of screw members "Z".

The base plate 3 is a circular plate that is mounted above the base 1 and the telescopic unit 2. The base plate 3 has a center formed with a circular hole 31 for passage of a drive gear "a" which meshes with each of the rack slide bars 21 that are mounted on a bottom of the base plate 3. The base plate 3 has a top provided with multiple threaded rods 32. The base plate 3 has a periphery formed with multiple elongated cutouts 33 aligning with the rack slide bars 21, and multiple short cutouts 34 each located between any two adjacent elongated cutouts 33. Each of the multiple elongated cutouts 33 has a bottom provided with two substantially L-shaped holding plates 331, so that each of the rack slide bars 21 is slidably mounted between the two substantially L-shaped holding plates 331. Each of the multiple short cutouts 34 has a bottom provided with a substantially U-shaped plate 341, so that each of the multiple short slide bars 22 is slidably mounted in the substantially U-shaped plates 341.

The open/close unit 4 is mounted above the base plate 3, and includes multiple larger sector plates 41 and multiple smaller sector plates 42 arranged in a staggered manner.

Each of the multiple larger sector plates 41 is rested on the top of the base plate 3, and has a surface formed with two arcuate slots 411. Each of the multiple larger sector plates 41 has a bottom having a mediate portion provided with a mounting block 412 which is secured on the distal end of a respective one of the multiple short slide bars 22 by screw members "Z", and is slidably mounted in a respective one of the multiple short cutouts 34 of the base plate 3.

Each of the multiple smaller sector plates 42 is mounted between any two adjacent larger sector plates 41 in a staggered manner, and has a surface provided with multiple intersecting ribs 421. Each of the multiple smaller sector plates 42 has a bottom having two sides each provided with a threaded post 422 which is received in an arcuate slot 411 of an adjacent larger sector plate 41, and is secured by a screw member "Z", so that the multiple larger sector plates 41 may be combined with the multiple smaller sector plates 42. The bottom of each of the multiple smaller sector plates 42 has a mediate portion provided with a plate block 423 which is secured on the distal end of a respective one of the multiple rack slide bars 21 by screw members "Z", and is slidably mounted in a respective one of the multiple elongated cutouts 33 of the base plate 3.

Figure 3:
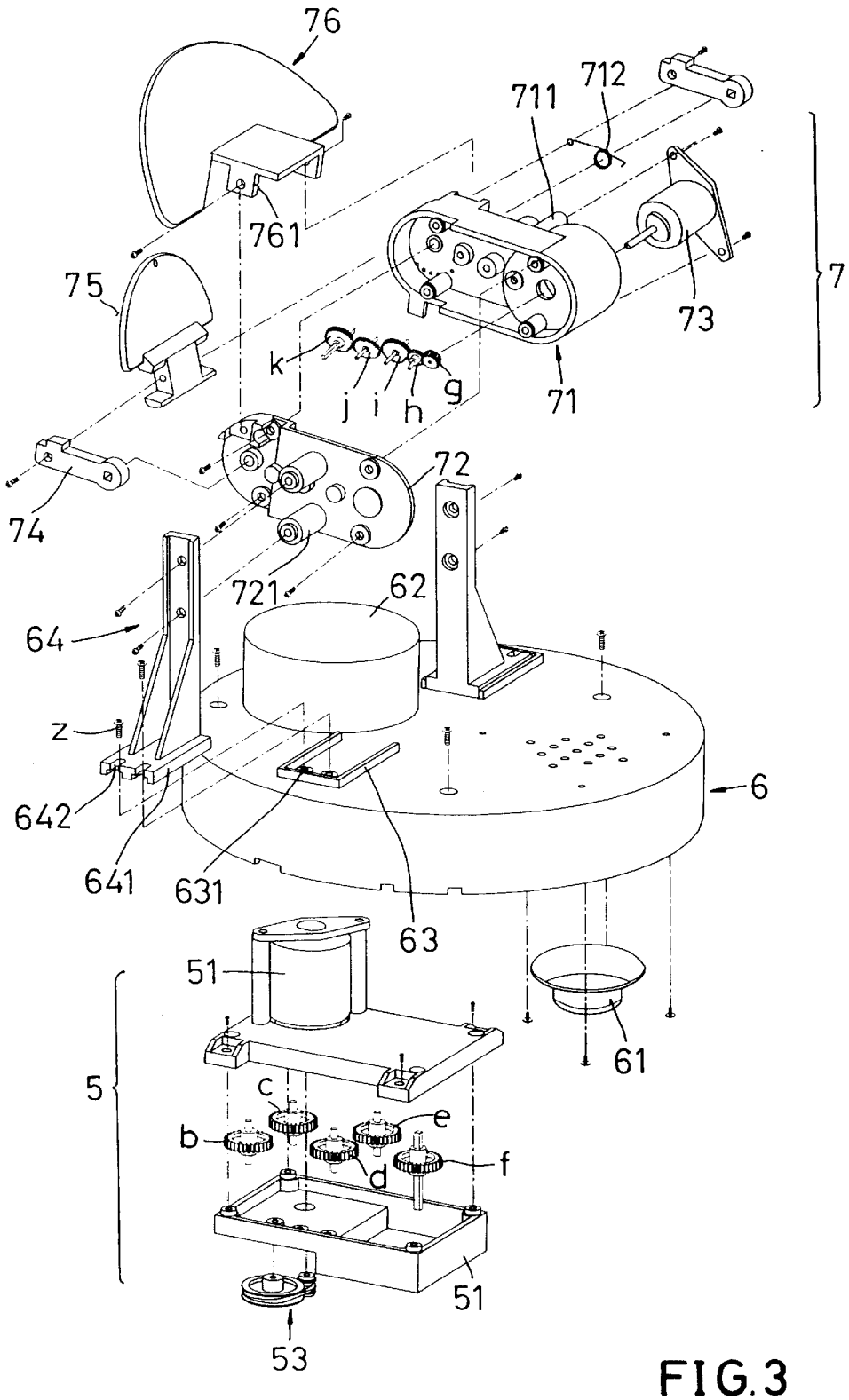
FIG. 3 is an exploded perspective view of an upper body of the wall suspension type toy structure in accordance with a preferred embodiment of the present invention.

As shown in FIGS. 1 and 3, the first drive unit 5 includes a hollow gearbox cover 51, and a first motor 52 secured on a top of the hollow-gearbox cover 51. The first motor 52 has a shaft that may drive a belt wheel set 53 which is mounted on a bottom of the hollow gearbox cover 51. The belt wheel set 53 may then in turn drive and rotate multiple reduction gears "b", "c", "d", "e" and "f" which are mounted in the hollow gearbox cover 51. The reduction gear "f" is co-axially connected with the drive gear "a".

The upper seat 6 is a hollow seat that is secured on the base plate 3 for receiving the first drive unit 5 and a horn 61. The upper seat 6 has a top formed with a motor chamber 62 for receiving the first motor 52 of the first drive unit 5. The top of the upper seat 6 is provided with two opposite U-shaped enclosures 63, and two opposite support racks 64 each secured in one of the two opposite U-shaped enclosures 63. Each of the two opposite U-shaped enclosures 63 is formed with two screw bores 631. Each of the two opposite support racks 64 has a bottom plate 641 formed with two slots 642 aligning with the two screw bores 631 of one of the two opposite U-shaped enclosures 63, for passage of screw members "Z", so that the bottom plate 641 of each of the two opposite support racks 64 may be secured in each of the two opposite U-shaped enclosures 63. Each of the two opposite support racks 64 is formed with two post holes 643.

The second drive unit 7 is secured on the two opposite support racks 64, and includes a main body 71, a side cover 72 combined with the main body 71, a second motor 73, two links 74, a lower lip plate 75, and an upper lip plate 76.

The main body 71 has an outer side provided with two threaded posts 711 aligning with the two post holes 643 of one of the two opposite support racks 64, for passage of screw members "Z", so that the main body 71 may be secured on the two opposite support racks 64.

The side cover 72 has an outer side provided with two threaded posts 721 aligning with the two post holes 643 of the other support rack 64, for passage of screw members "Z", so that the side cover 72 may be secured on the other support rack 64.

The second motor 73 is mounted in the main body 71, and has a shaft that may in turn drive and rotate multiple reduction gears "g", "h", "i", "j" and "k" which are mounted in the main body 71. The reduction gear "k" has a shaft which has two ends protruded outward from the main body 71 and the side cover 72 respectively.

Each of the two links 74 has a first end secured on one of the two ends of the shaft of the reduction gear "k", and a second end secured with a lower portion of the lower lip plate 75. A torsion spring 712 is mounted between the lower portion of the lower lip plate 75 and the main body 71.

The upper lip plate 76 is secured on the main body 71, and is located above the lower lip plate 75. The upper lip plate 76 has a lower portion provided with an inverted U-shaped connecting plate 761 secured on the main body 71 and the side cover 72.

Figure 4:
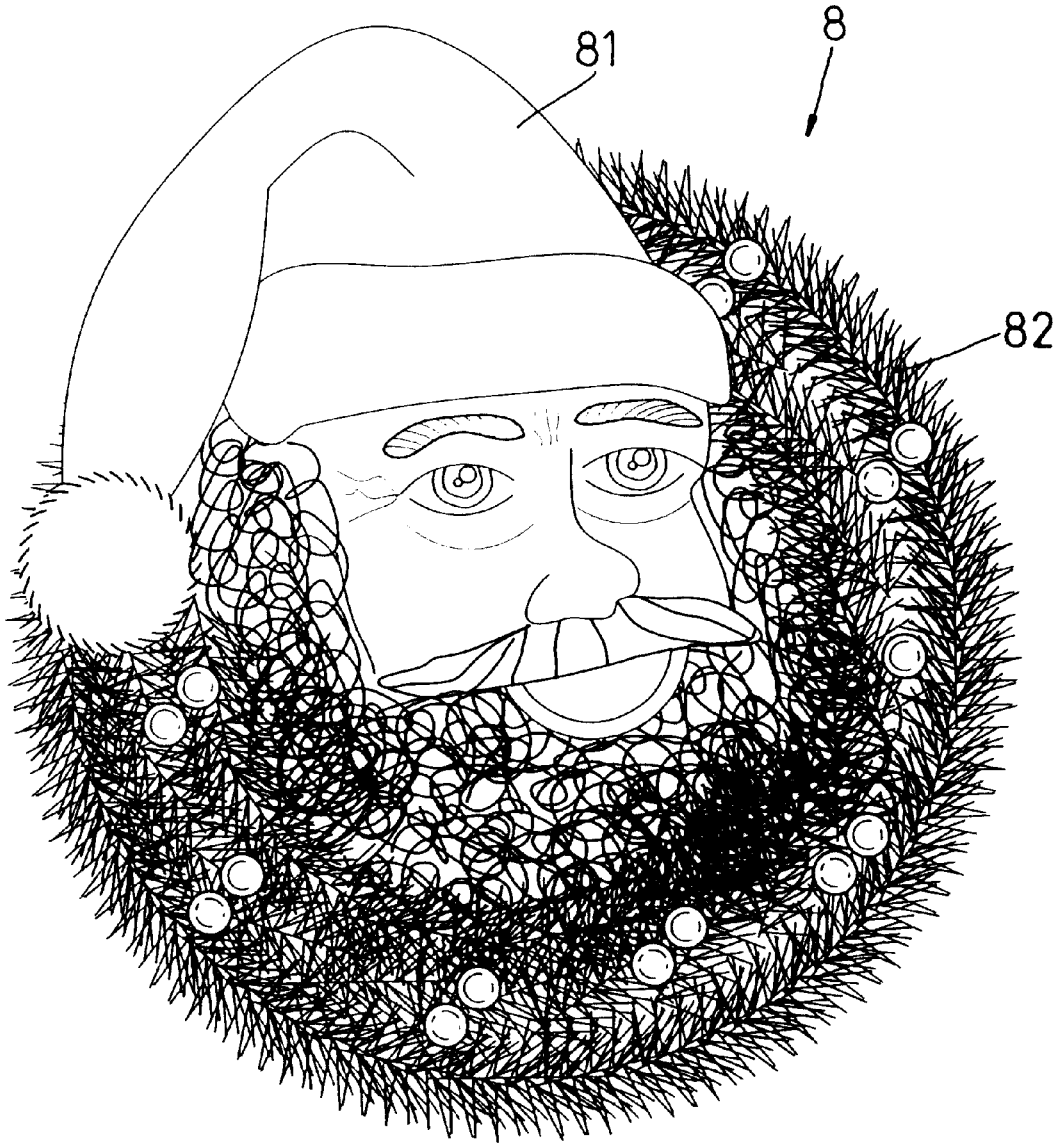
FIG. 4 is a perspective view of an ornament of the wall suspension type toy structure in accordance with a preferred embodiment of the present invention.
Figure 5:
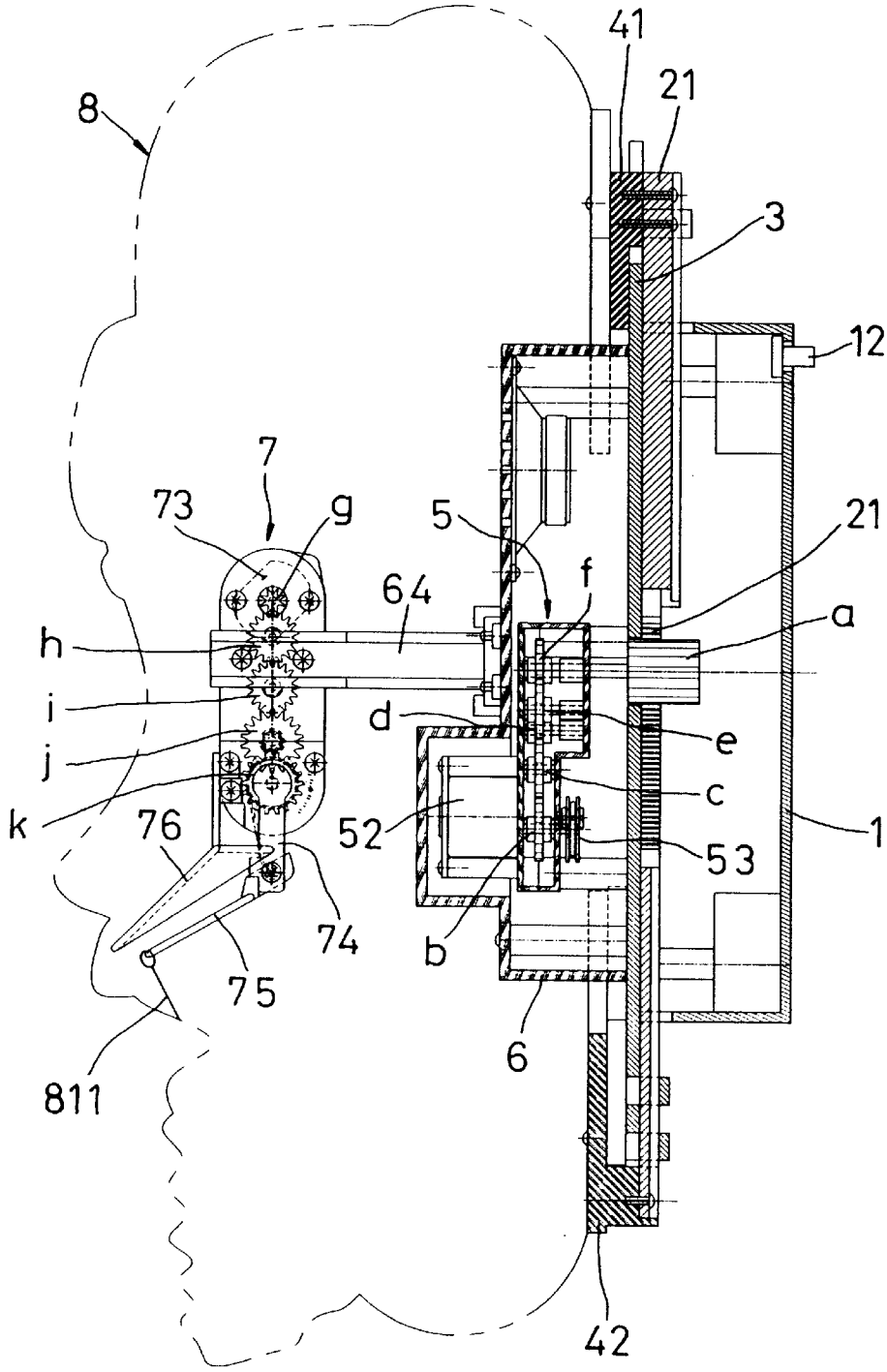
FIG. 5 is a side plan cross-sectional assembly view of the wall suspension type toy structure in accordance with a preferred embodiment of the present invention.

As shown in FIGS. 1 and 4, the ornament 8 includes an outer shade 81, and a flower loop decoration 82. The outer shade 81 is mounted on the upper seat 6 and the second drive unit 7, and is supported by the upper lip plate 76 and the lower lip plate 75 of the second drive unit 7. A pull rope 811 is connected between the outer shade 81 and the lower lip plate 75 as shown in FIG. 5. The flower loop decoration 82 is secured on the open/close unit 4, and is mounted around the outer shade 81.

Figure 6:
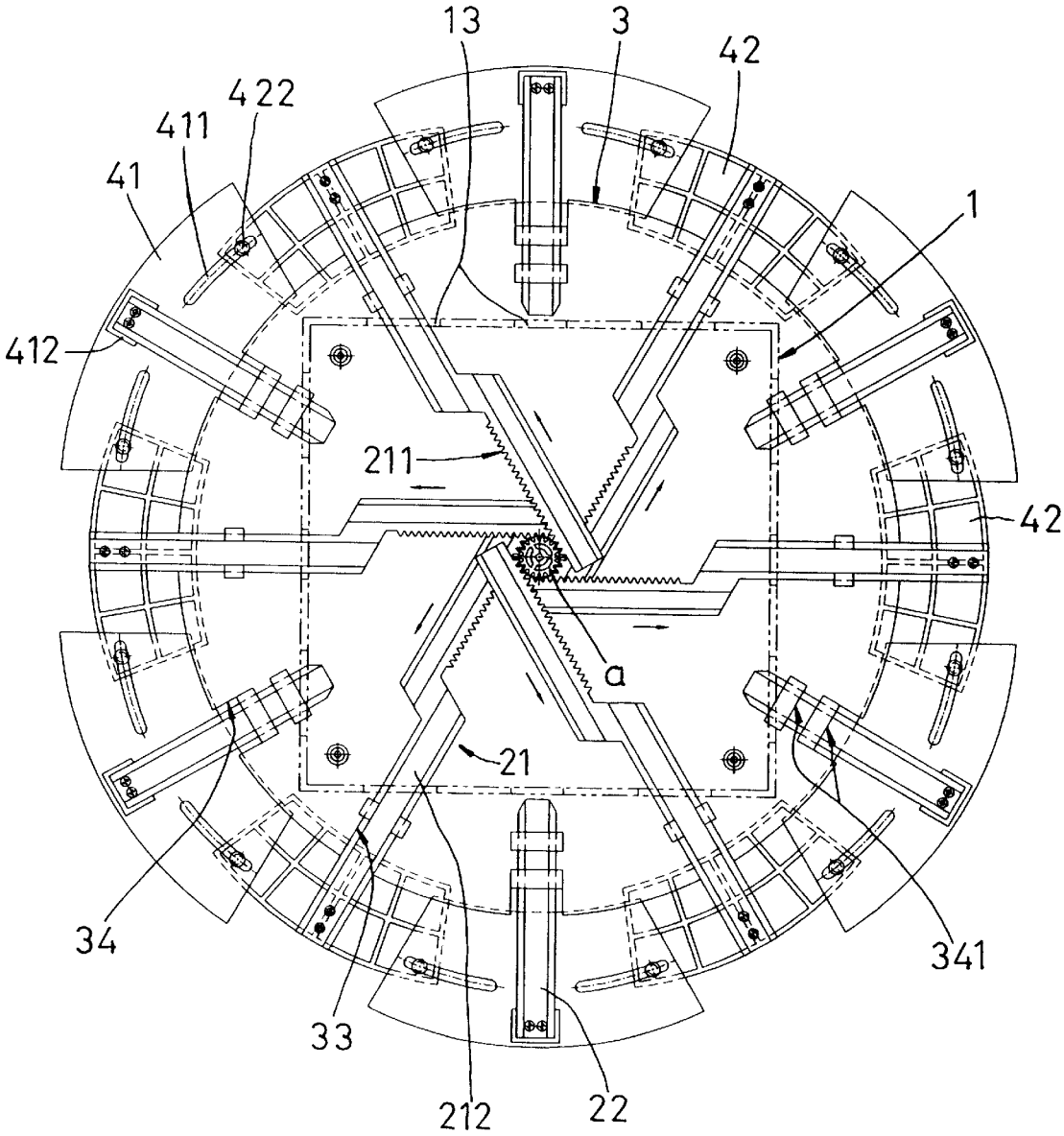
FIG. 6 is a top plan assembly view of the wall suspension type toy structure in accordance with a preferred embodiment of the present invention.
Figure 7:
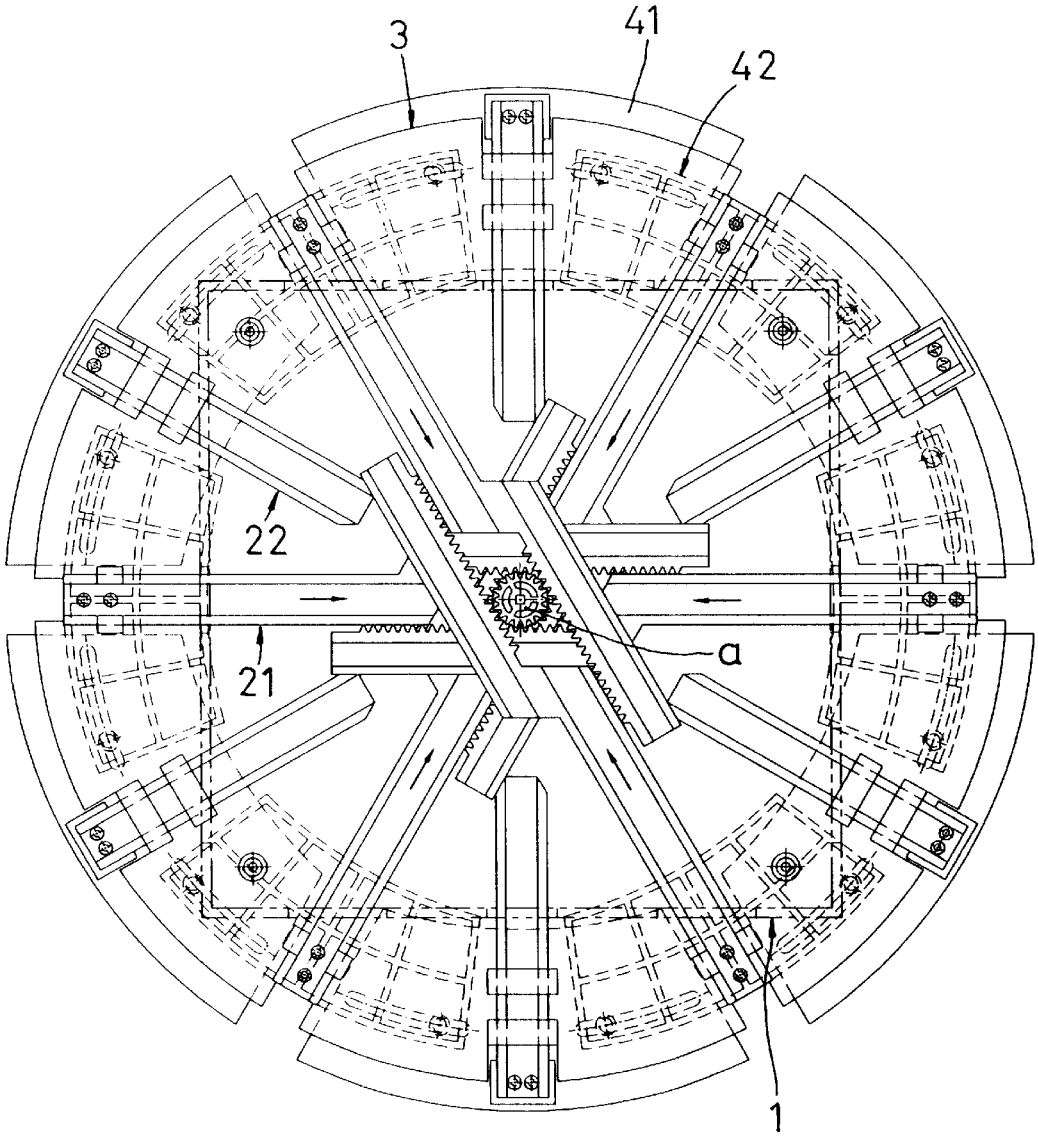
FIG. 7 is a schematic operational view of the wall suspension type toy structure as shown in FIG. 6 in use.

In operation, referring to FIGS. 5–10 with reference to FIGS. 1–4, the wall suspension type toy structure in accordance with a preferred embodiment of the present invention may be hanged on the wall or the door plate as shown in FIG. 5. After the switch 12 is turned on to connect the electric power, the first motor 52 in the upper seat 6 is operated to rotate, so as to drive the belt wheel set 53 which may then in turn drive and rotate the multiple reduction gears "b", "c", "e" and "f", and the reduction gear "f" co-axially connected with the drive gear "a" may drive and rotate the drive gear "a" which may drive the multiple rack slide bars 21 to reciprocally move outward as shown in FIG. 6 or inward as shown in FIG. 7 in a radiating manner, so that the multiple smaller sector plates 42 secured on the distal ends of the multiple rack slide bars 21 may be pushed outward or pulled inward, and the multiple larger sector plates 41 may be protruded outward or retracted inward by the multiple smaller sector plates 42, such that the flower loop decoration 82 secured on the open/close unit 4 may be expanded or contracted.

Figure 8:
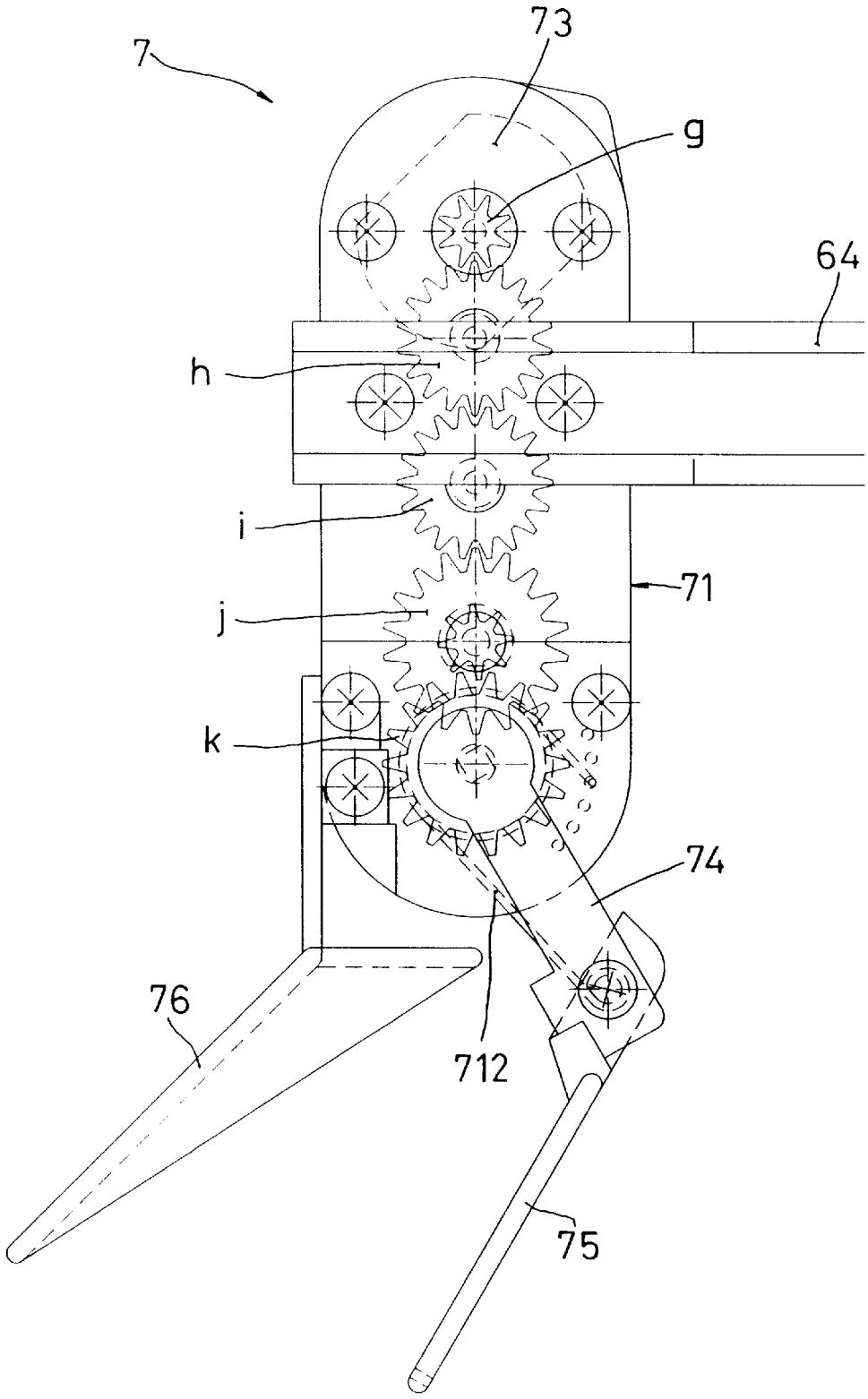
FIG. 8 is a partially enlarged view of the wall suspension type toy structure as shown in FIG. 5.
Figure 9:
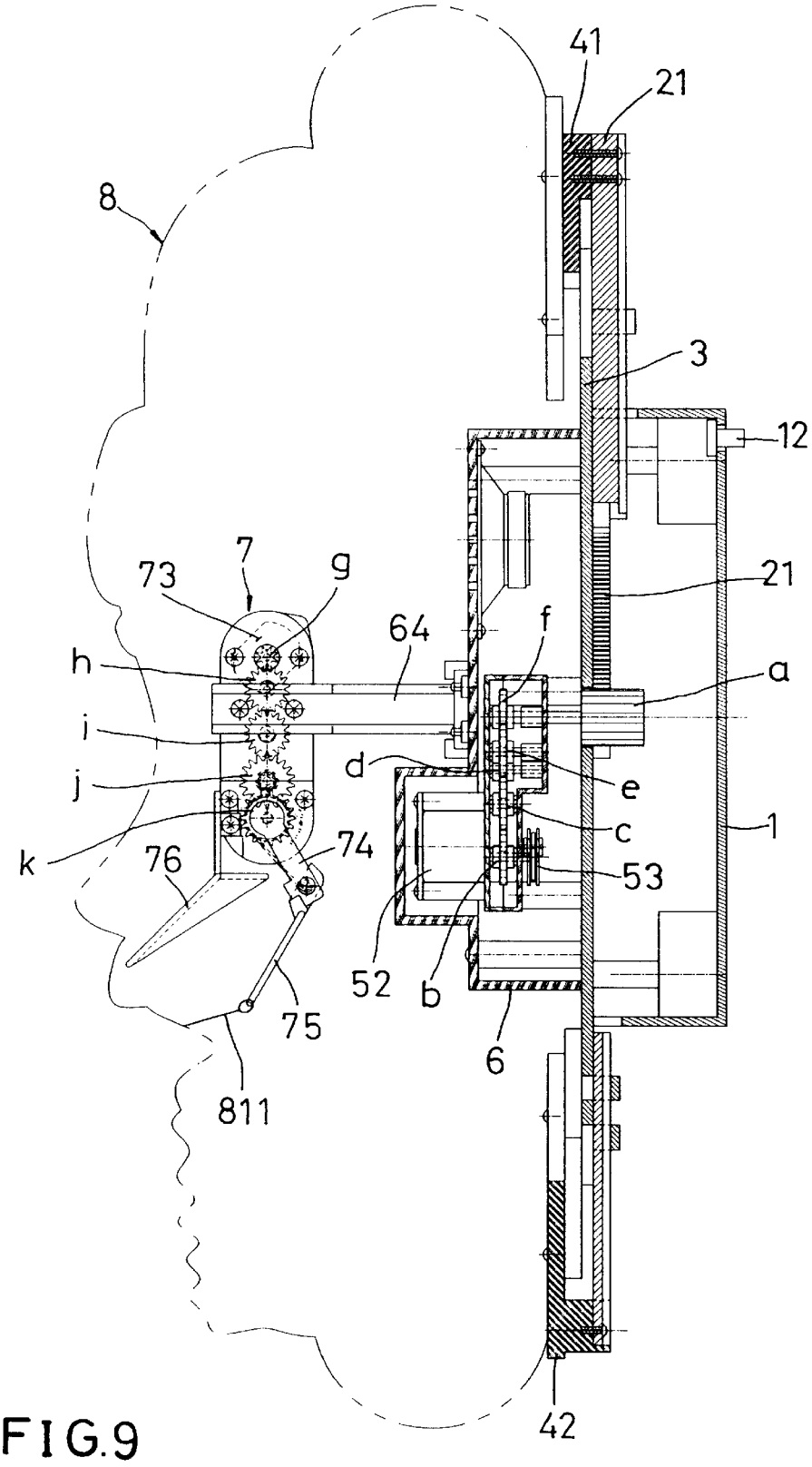
FIG. 9 is a schematic operational view of the wall suspension type toy structure as shown in FIG. 5 in use.

After the first motor 52 is operated, the second motor 73 in the second drive unit 7 is also operated to in turn drive and rotate the multiple reduction gears "g", "h", "i", "j" and "k", and the two ends of the shaft of the reduction gear "k" may drive the two links 74 and the lower lip plate 75 to pivot outward relative to the upper lip plate 76 as shown in FIG. 8, so that the lower lip plate 75 may pull the pull rope 811 which may draw the lower lip of the outer shade 81 to stimulate the action of opening the mouth of the outer shade 81 as shown in FIG. 9.

Figure 10:
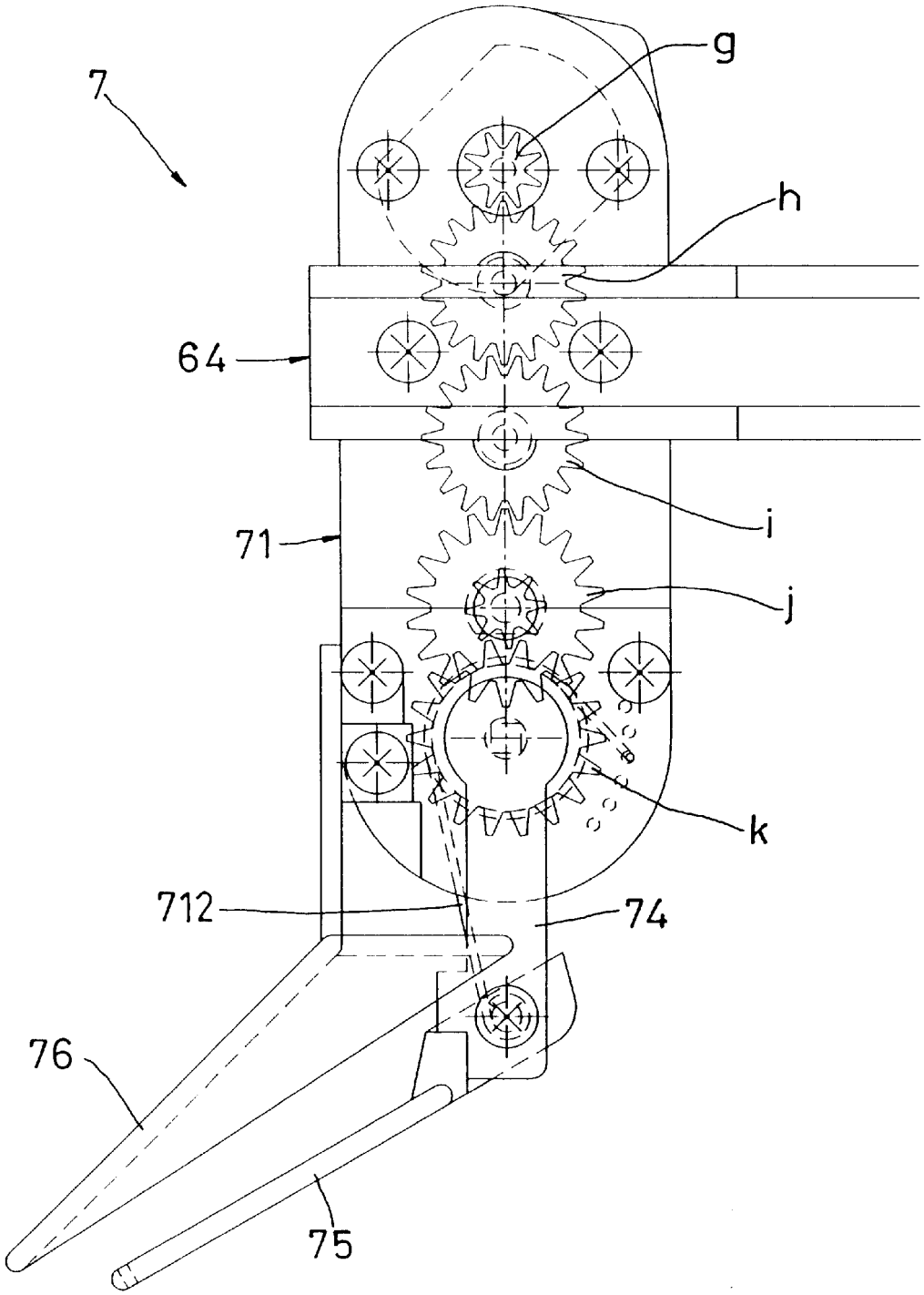
FIG. 10 is a schematic operational view of the wall suspension type toy structure as shown in FIG. 8 in use.

When the second motor 73 stops operation, the two links 74 and the lower lip plate 75 may be returned the original closed position by the restoring force of the torsion spring 712 mounted between the lower portion of the lower lip plate 75 and the main body 71, so that the lower lip plate 75 may pull the pull rope 811 which may release the lower lip of the outer shade 81, thereby closing the mouth of the outer shade 81 as shown in FIGS. 5 and 10.

Thus, the flower loop decoration 82 may be expanded or contracted, and the mouth of the outer shade 81 may be opened and closed, thereby providing a lively amusement effect.

Figure 11B:
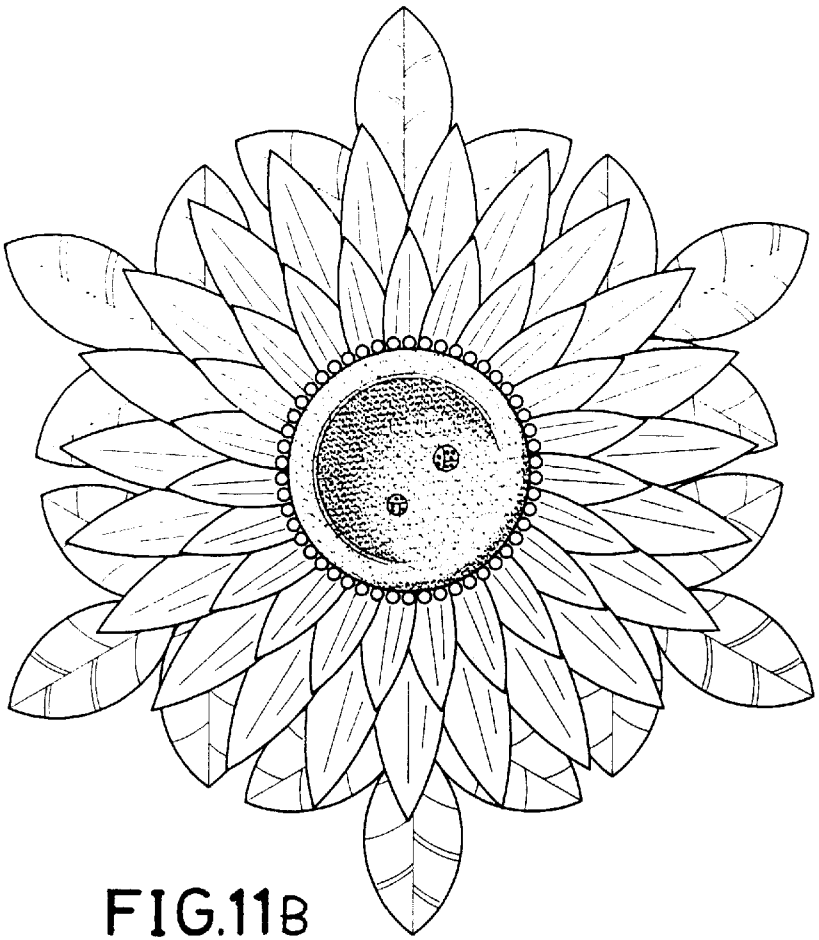
FIG. 11B is a schematic operational view of the wall suspension type toy structure as shown in FIG. 11A in use.
Figure 11A:
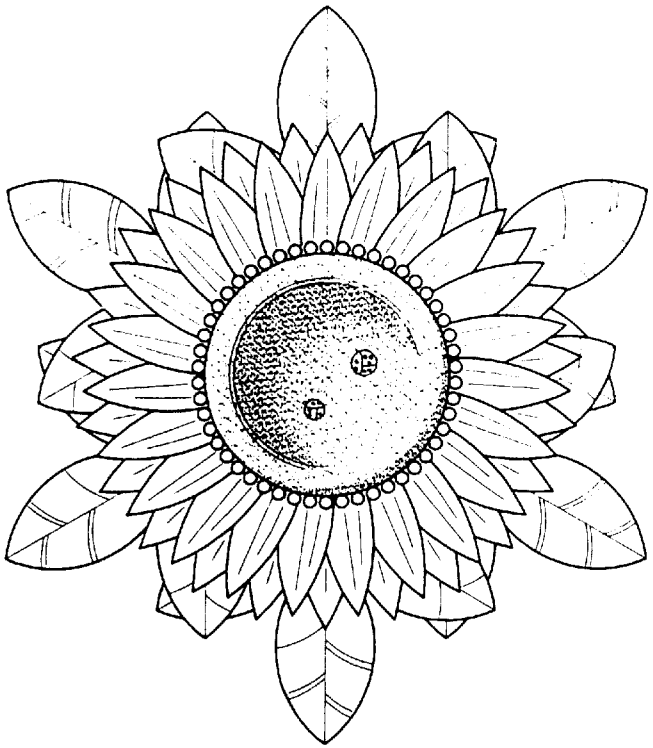
FIG. 11A is a top plan view of a wall suspension type toy structure in accordance with another embodiment of the present invention.

Referring to FIGS. 11A and 11B, a wall suspension type toy structure in accordance with another embodiment of the present invention is shown, wherein the second drive unit 7 is removed, and the open/close unit 4 is provided with simulated flower decorations. Thus, the multiple smaller sector plates 42 may be pushed outward or pulled inward, and the multiple larger sector plates 41 may be protruded outward or retracted inward, such that the simulated flower decorations secured on the open/close unit 4 may be contracted as shown in FIG. 11A or expanded as shown in FIG. 11B.

Figure 12B:
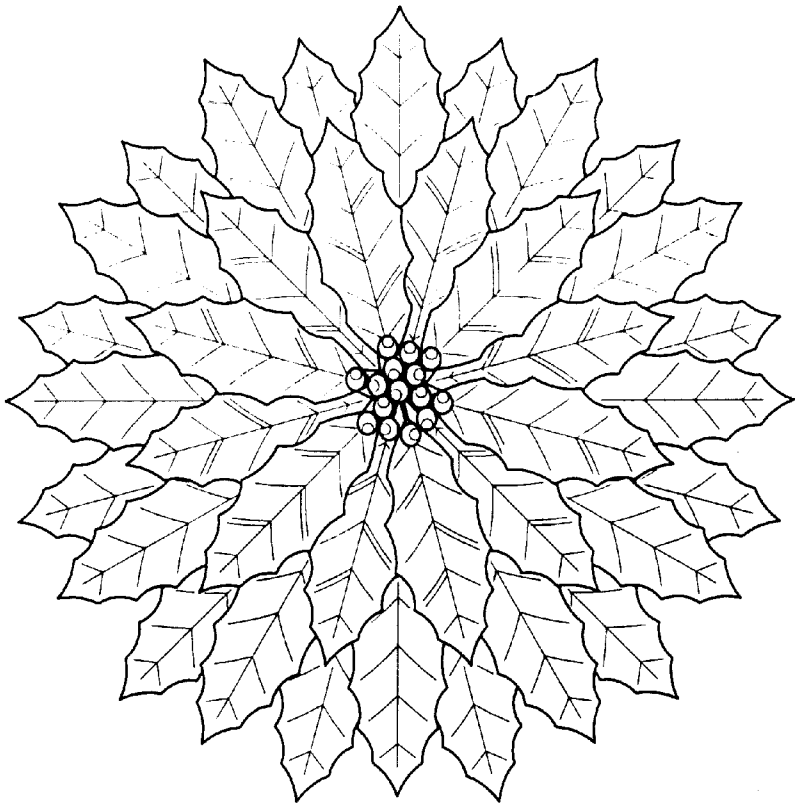
FIG. 12B is a schematic operational view of the wall suspension type toy structure as shown in FIG. 12A in use.
Figure 12A:
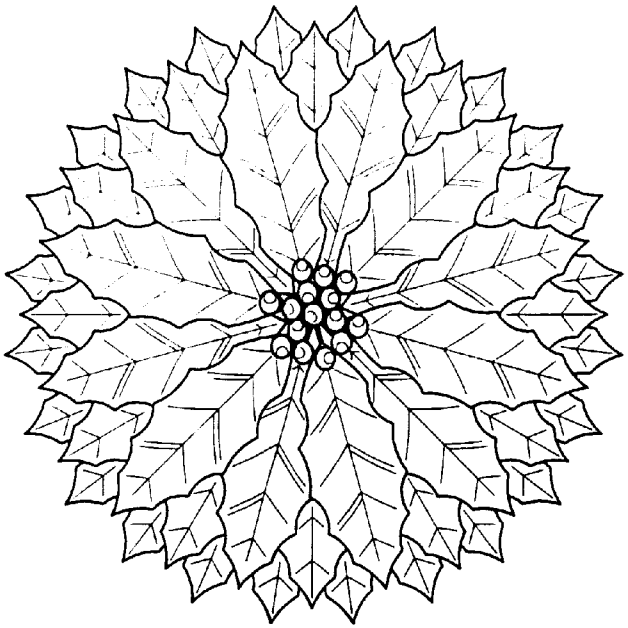
FIG. 12A is a top plan view of a wall suspension type toy structure in accordance with another embodiment of the present invention.

Referring to FIGS. 12A and 12B, a wall suspension type toy structure in accordance with another embodiment of the present invention is shown, wherein the second drive unit 7 is removed, and the open/close unit 4 is provided with simulated flower decorations. Thus, the multiple smaller sector plates 42 may be pushed outward or pulled inward, and the multiple larger sector plates 41 may be protruded outward or retracted inward, such that the simulated flower decorations secured on the open/close unit 4 may be contracted as shown in FIG. 12A or expanded as shown in FIG. 12B.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A wall suspension type toy structure, comprising a base, a telescopic unit, a base plate, an open/close unit, a first drive unit, and an upper seat, wherein:

the base is a rectangular hollow box, and has an inside provided with a battery compartment and a switch located beside the battery compartment, the base has four sides each formed with multiple cavities, two protruding ears are mounted on two opposite sides of the base;

the telescopic unit includes multiple substantially Z-shaped rack slide bars arranged in a radiating manner, and multiple short slide bars each mounted between any two adjacent rack slide bars, each of the rack slide bars is matingly received in one of the multiple cavities of the base, each of the rack slide bars has a first end formed with multiple engaging teeth and a second end formed with a flat mounting section which has a distal end formed with two screw bores for screwing of screw members, each of the multiple short slide bars is an elongate rectangular bar that is received in one of the multiple cavities 13 of the base, each of the multiple short slide bars has a distal end formed with two screw bores for screwing of screw members;

the base plate is a circular plate that is mounted above the base and the telescopic unit, the base plate has a center formed with a circular hole for passage of a drive gear which meshes with each of the rack slide bars that are mounted on a bottom of the base plate, the base plate has a top provided with multiple threaded rods, the base plate has a periphery formed with multiple elongated cutouts aligning with the rack slide bars, and multiple short cutouts each located between any two adjacent elongated cutouts, each of the multiple elongated cutouts has a bottom provided with two substantially L-shaped holding plates, so that each of the rack slide bars is slidably mounted between the two substantially L-shaped holding plates, each of the multiple short cutouts has a bottom provided with a substantially U-shaped plate, so that each of the multiple short slide bars is slidably mounted in the substantially U-shaped plates;

the open/close unit is mounted above the base plate, and includes multiple larger sector plates and multiple smaller sector plates arranged in a staggered manner, each of the multiple larger sector plates is rested on the top of the base plate, and has a surface formed with two arcuate slots, each of the multiple larger sector plates has a bottom having a mediate portion provided with a mounting block which is secured on the distal end of a respective one of the multiple short slide bars by screw members, and is slidably mounted in a respective one of the multiple short cutouts of the base plate, each of the multiple smaller sector plates is mounted between any two adjacent larger sector plates in a staggered manner, and has a surface provided with multiple intersecting ribs, each of the multiple smaller sector plates has a bottom having two sides each provided with a threaded post which is received in an arcuate slot of an adjacent larger sector plate, and is secured by a screw member, so that the multiple larger sector plates may be combined with the multiple smaller sector plates, the bottom of each of the multiple smaller sector plates has a mediate portion provided with a plate block which is secured on the distal end of a respective one of the multiple rack slide bars by screw members, and is slidably mounted in a respective one of the multiple elongated cutouts of the base plate;

the first drive unit includes a hollow gearbox cover, and a first motor secured on a top of the hollow gearbox cover, the first motor has a shaft that may drive a belt wheel set which is mounted on a bottom of the hollow gearbox cover, the belt wheel set may in turn drive and rotate multiple reduction gears which are mounted in the hollow gearbox cover, one of the reduction gears is co-axially connected with the drive gear; and the upper seat is a hollow seat that is secured on the base plate for receiving the first drive unit and a horn, the upper seat has a top formed with a motor chamber for receiving the first motor of the first drive unit, the top of the upper seat is provided with two opposite U-shaped enclosures, and two opposite support racks each secured in one of the two opposite U-shaped enclosures, each of the two opposite U-shaped enclosures is formed with two screw bores, each of the two opposite support racks has a bottom plate formed with two slots aligning with the two screw bores of one of the two opposite U-shaped enclosures, for passage of screw members, so that the bottom plate of each of the two opposite support racks may be secured in each of the two opposite U-shaped enclosures, each of the two opposite support racks is formed with two post holes.

2. The wall suspension type toy structure in accordance with claim 1, further comprising a second drive unit secured on the two opposite support racks, and including a main body, a side cover combined with the main body, a second motor, two links, a lower lip plate, and an upper lip plate, wherein:

the main body has an outer side provided with two threaded posts aligning with the two post holes of one of the two opposite support racks, for passage of screw members, so that the main body may be secured on the two opposite support racks;

the side cover has an outer side provided with two threaded posts aligning with the two post holes of the other support rack, for passage of screw members, so that the side cover may be secured on the other support rack;

the second motor is mounted in the main body, and has a shaft that may in turn drive and rotate multiple reduction gears which are mounted in the main body, and one of the reduction gears has a shaft which has two ends protruded outward from the main body and the side cover respectively;

each of the two links has a first end secured on one of the two ends of the shaft of the one reduction gear, and a second end secured with a lower portion of the lower lip plate, a torsion spring is mounted between the lower portion of the lower lip plate and the main body; and the upper lip plate is secured on the main body, and is located above the lower lip plate, the upper lip plate has a lower portion provided with an inverted U-shaped connecting plate secured on the main body and the side cover.

3. The wall suspension type toy structure in accordance with claim 1, further comprising an ornament including an outer shade, and a flower loop decoration, wherein:

the outer shade is mounted on the upper seat and the second drive unit, and is supported by the upper lip plate and the lower lip plate of the second drive unit; and the flower loop decoration is secured on the open/close unit, and is mounted around the outer shade.

4. The wall suspension type toy structure in accordance with claim 3, wherein the ornament further includes a pull rope connected between the outer shade and the lower lip plate.

5. The wall suspension type toy structure in accordance with claim 1, wherein the open/close unit is provided with simulated flower decorations, whereby the multiple smaller sector plates may be pushed outward or pulled inward, and the multiple larger sector plates may be protruded outward or retracted inward, such that the simulated flower decorations secured on the open/close unit may be contracted or expanded.

* * * * *